US011629450B2

(12) United States Patent
Afajalpurkar et al.

(10) Patent No.: US 11,629,450 B2
(45) **Date of Patent: *Apr. 18, 2023**

(54) WATER DELIVERY NOZZLES FOR CHEMISTRY DISPENSING SYSTEM

(71) Applicant: WHIRLPOOL CORPORATION, Benton Harbor, MI (US)

(72) Inventors: Vinayak A. Afajalpurkar, Maharashtra (IN); James J. Beaudreault, Lincoln, RI (US); Prabhath KV, Nellore (IN); Eamon C. Lyons, Somerset, MA (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/563,173

(22) Filed: Dec. 28, 2021

(65) Prior Publication Data

US 2022/0120015 A1 Apr. 21, 2022

Related U.S. Application Data

(60) Continuation of application No. 17/068,175, filed on Oct. 12, 2020, now Pat. No. 11,242,641, which is a division of application No. 16/252,977, filed on Jan. 21, 2019, now Pat. No. 10,829,883.

(51) Int. Cl.
*D06F 39/02* (2006.01)

(52) U.S. Cl.
CPC ..... *D06F 39/02* (2013.01)

(58) Field of Classification Search
CPC ..... D06F 39/02
See application file for complete search history.

(56) References Cited

U.S. PATENT DOCUMENTS

| | | | |
|---|---|---|---|
| 3,896,641 | A | 7/1975 | Worst |
| 3,949,576 | A | 4/1976 | Waugh et al. |
| 3,975,931 | A | 8/1976 | Bischkopf |
| 7,770,418 | B2 | 8/2010 | Kramme et al. |
| 8,171,757 | B2 | 5/2012 | Dahlke |
| 8,991,220 | B2 | 3/2015 | Buso et al. |
| 9,404,211 | B2 | 8/2016 | Hill et al. |
| 9,644,308 | B2 | 5/2017 | Leibman et al. |
| 9,702,078 | B2 | 7/2017 | Lee |
| 9,809,922 | B2 | 11/2017 | Salomonsson |

(Continued)

FOREIGN PATENT DOCUMENTS

| | | |
|---|---|---|
| DE | 2253094 | 5/1974 |
| EP | 1463854 | 10/2004 |

(Continued)

*Primary Examiner* — Jason Y Ko
(74) *Attorney, Agent, or Firm* — Price Heneveld LLP

(57) ABSTRACT

A laundry appliance includes a drum that is rotationally operable within a wash tub. A chemistry receptacle is located proximate the drum. A chemistry dispensing module is coupled to the chemistry receptacle and has a prewash portion and a main wash portion. A first fluid inlet is coupled with the prewash portion and a second fluid inlet is coupled to the main wash portion. An outlet extends from the chemistry dispensing module to a laundry treating chamber. A prewash nozzle is coupled to the first fluid inlet and the prewash portion. The prewash nozzle includes an elongated arcuate body that follows a curvature of the prewash portion and defines a cyclonic flow path from the prewash nozzle to the outlet.

20 Claims, 11 Drawing Sheets

(56) References Cited

U.S. PATENT DOCUMENTS

| | | | |
|---|---|---|---|
| 9,903,064 | B2 | 2/2018 | Del Pos et al. |
| 2016/0090681 | A1 | 3/2016 | Nash et al. |
| 2017/0298563 | A1 | 10/2017 | Roetker et al. |
| 2018/0298543 | A1 | 10/2018 | Beaudrault et al. |

FOREIGN PATENT DOCUMENTS

| | | |
|---|---|---|
| EP | 3184688 | 6/2017 |
| WO | 2019003460 | 1/2019 |

WATER DELIVERY NOZZLES FOR CHEMISTRY DISPENSING SYSTEM

CROSS-REFERENCE TO RELATED APPLICATION

The present application is a continuation of U.S. patent application Ser. No. 17/068,175 filed Oct. 12, 2020, now U.S. Pat. No. 11,242,641, which is a divisional of U.S. patent application Ser. No. 16/252,977 filed Jan. 21, 2019, entitled WATER DELIVERY NOZZLES FOR CHEMISTRY DISPENSING SYSTEM, now U.S. Pat. No. 10,829,883, the entire disclosures of which are hereby incorporated herein by reference.

FIELD OF THE DEVICE

The device is in the field of chemistry delivery for appliances, and more specifically, a chemistry delivery system for a laundry appliance that utilizes a prewash nozzle and a main wash nozzle for rinsing chemistry from a module into a drum.

SUMMARY

In at least one aspect, a laundry appliance includes a drum that is rotationally operable within a wash tub. A chemistry receptacle is located proximate the drum. A chemistry dispensing module is coupled to the chemistry receptacle and has a prewash portion and a main wash portion. A first fluid inlet is coupled with the prewash portion and a second fluid inlet is coupled to the main wash portion. An outlet extends from the chemistry dispensing module to a laundry treating chamber. A prewash nozzle is coupled to the first fluid inlet and the prewash portion. The prewash nozzle includes an elongated arcuate body that follows a curvature of the prewash portion and defines a cyclonic flow path from the prewash nozzle to the outlet.

In at least another aspect, a chemistry dispensing module for a laundry appliance includes a dispenser housing having a prewash portion and a main wash portion. A first fluid inlet is coupled with the prewash portion and a second fluid inlet is coupled to the main wash portion. The prewash portion has a rounded end. An outlet extends from the chemistry dispensing module to a laundry treating chamber. A prewash nozzle is slidably coupled to the first fluid inlet and the prewash portion. The prewash nozzle includes an elongated arcuate body that seats within the rounded end and defines a laminar flow path from the prewash nozzle to the outlet. The prewash portion is positioned at least partially below the main wash portion.

In at least another aspect, a chemistry dispensing module for a laundry appliance includes a dispenser housing having an outlet. A first fluid inlet is included within a prewash portion of the dispenser housing. The prewash portion includes a rounded end. A second fluid inlet is included within a main wash portion of the dispenser housing. The main wash portion is at least partially positioned over the prewash portion. A prewash nozzle is slidably coupled to the first fluid inlet. The prewash nozzle includes an elongated arcuate body that seats within the rounded end and defines a laminar flow path from the prewash nozzle to the outlet. A main wash nozzle has an angled deflector and is slidably coupled with the second fluid inlet. The angled deflector is adapted to redirect a main wash fluid through the main wash portion and to the outlet.

These and other features, advantages, and objects of the present device will be further understood and appreciated by those skilled in the art upon studying the following specification, claims, and appended drawings.

DETAILED DESCRIPTION OF EMBODIMENTS

Figure 1:
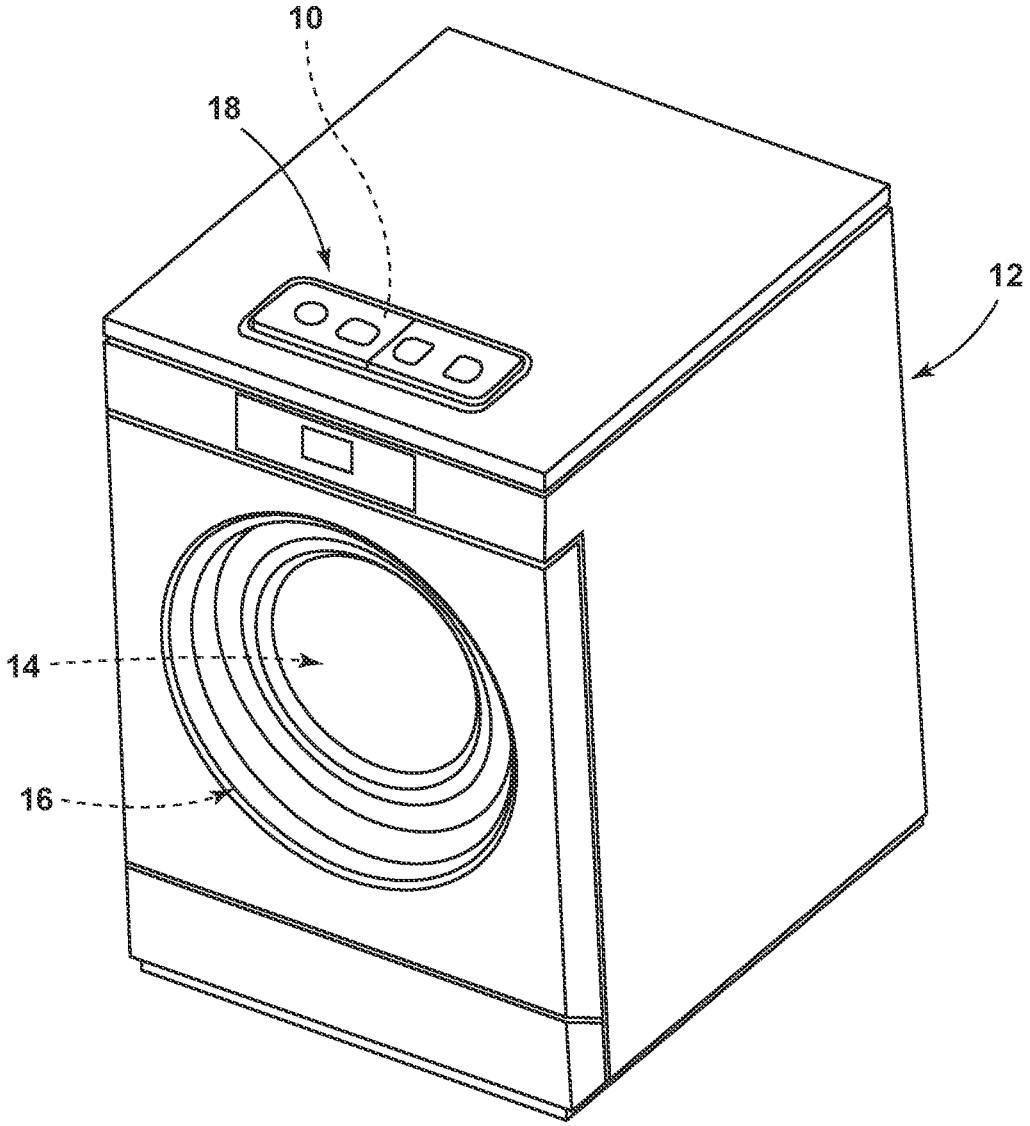
FIG. 1 is a front elevational view of the laundry appliance incorporating an aspect of the chemistry dispensing module.
Figure 2:
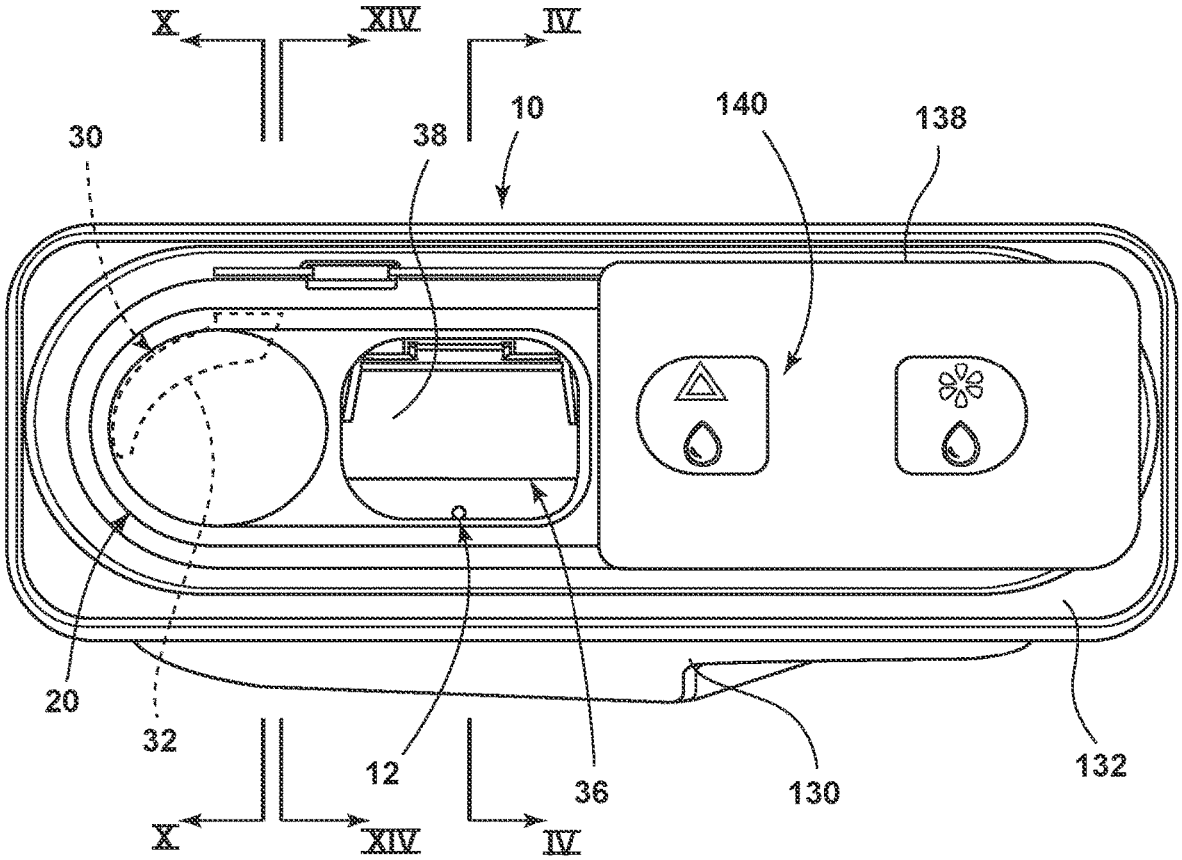
FIG. 2 is a top plan view of the chemistry dispensing module incorporating aspects of the prewash and main wash nozzles.
Figure 3:
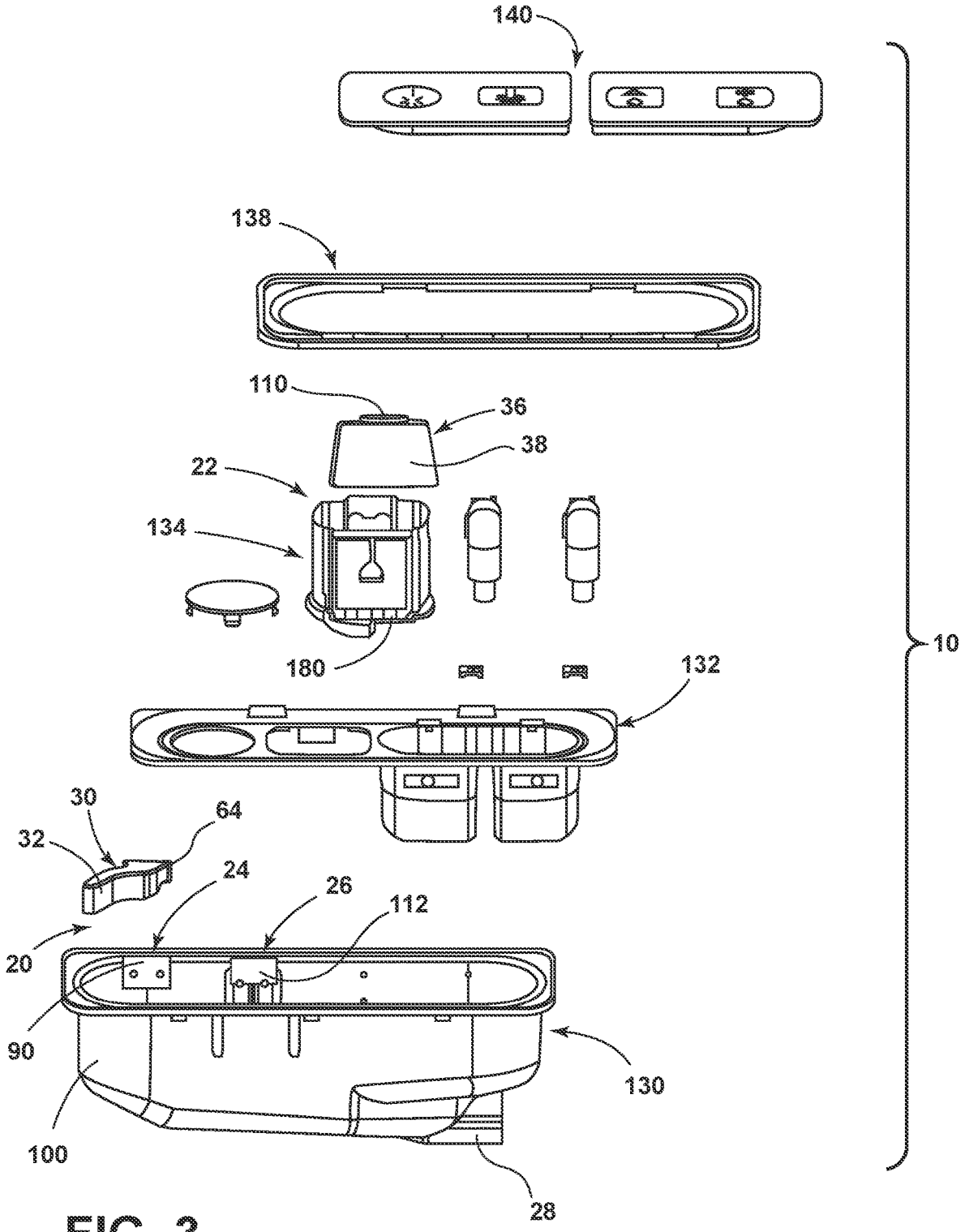
FIG. 3 is an exploded perspective view of the chemistry dispensing module of FIG. 2.
Figure 4:
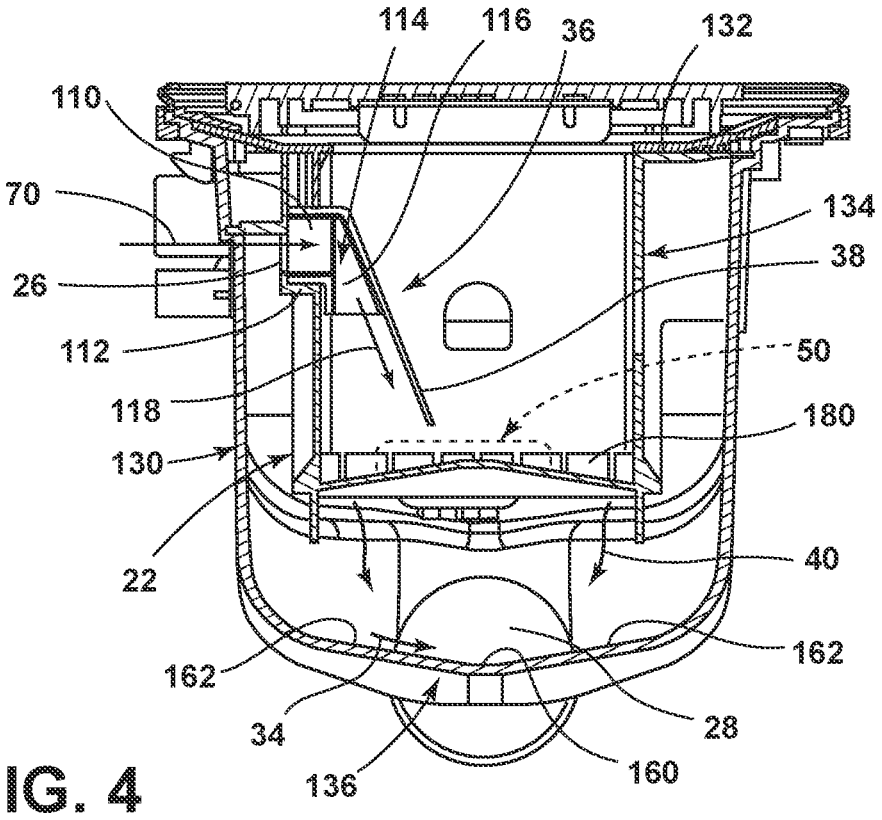
FIG. 4 is a cross-sectional view of the chemistry dispensing module of FIG. 2 taken along line IV-IV.
Figure 5:
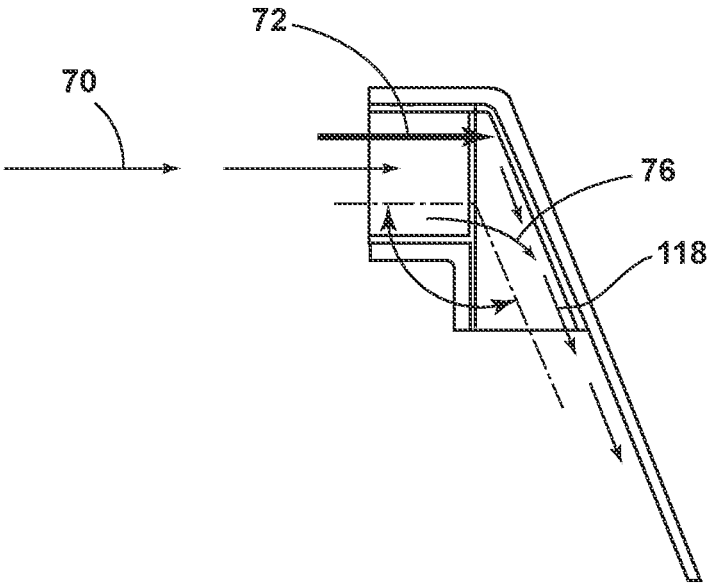
FIG. 5 is a cross-sectional view of the main wash nozzle and showing a deflecting flow of fluid.
Figure 6:
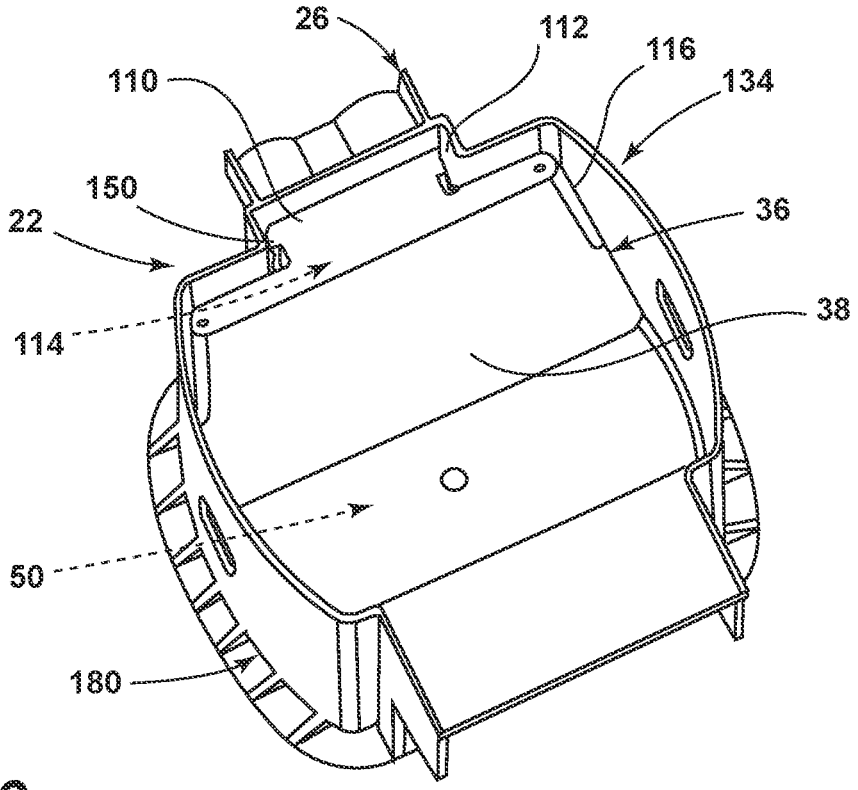
FIG. 6 is a top perspective view of a main wash portion of an aspect of the chemistry dispensing module.
Figure 7:
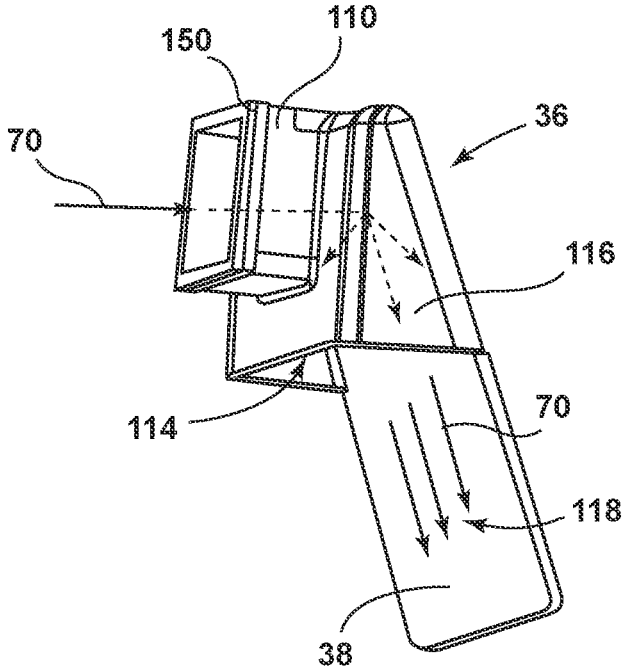
FIG. 7 is a side perspective view of the main wash nozzle of FIG. 5.
Figure 8:
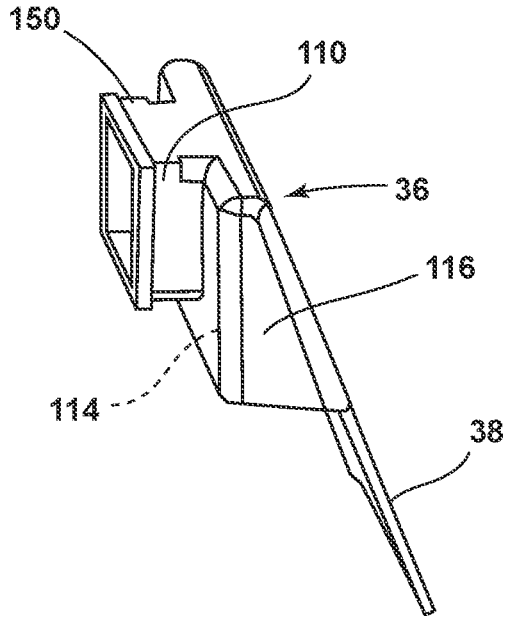
FIG. 8 is a top perspective view of the main wash nozzle of FIG. 7.
Figure 9:
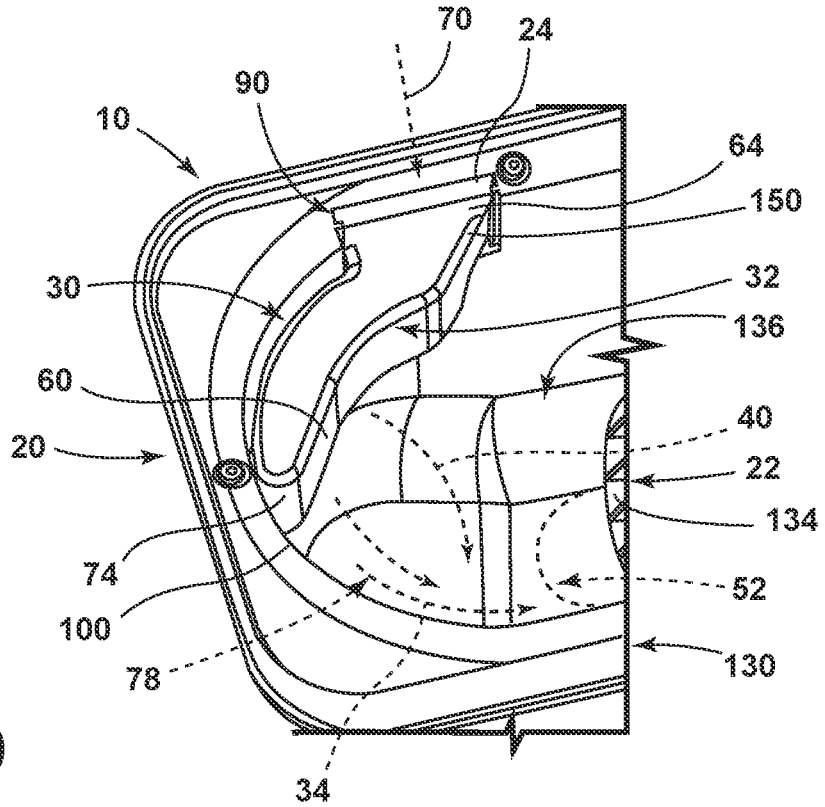
FIG. 9 is a top perspective view of an aspect of the prewash portion of the chemistry dispensing module and showing placement of the prewash nozzle.
Figure 10:
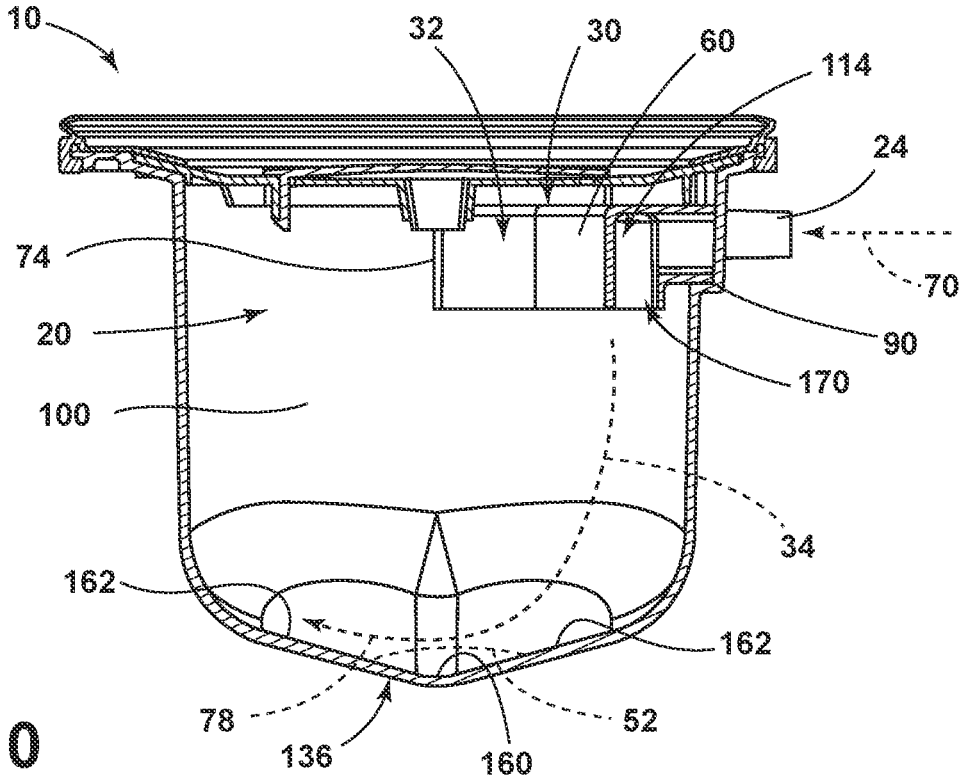
FIG. 10 is a cross-sectional view of the prewash portion of the chemistry dispensing module of FIG. 2 take along line X-X.
Figure 11:
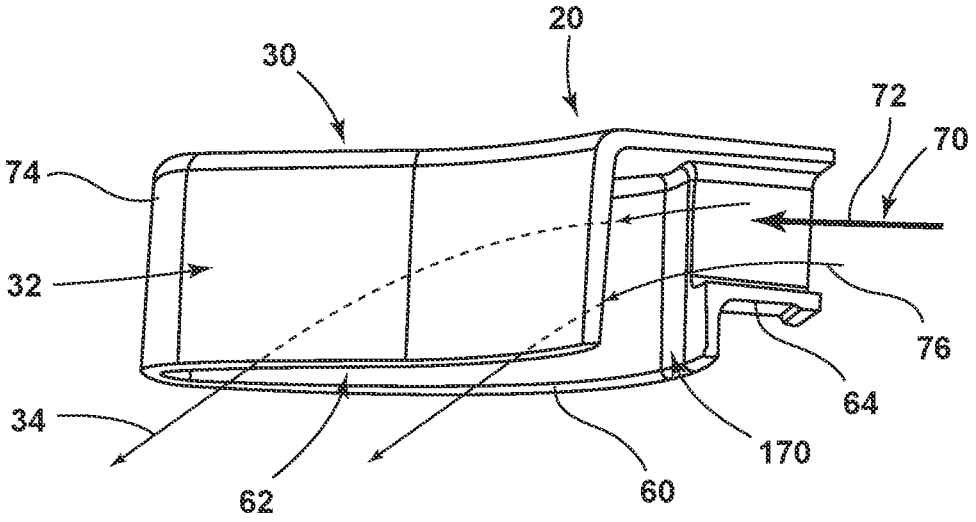
FIG. 11 is a perspective cross-sectional view of an aspect of the prewash nozzle of FIG. 9 showing movement of fluid therethrough.
Figure 12:
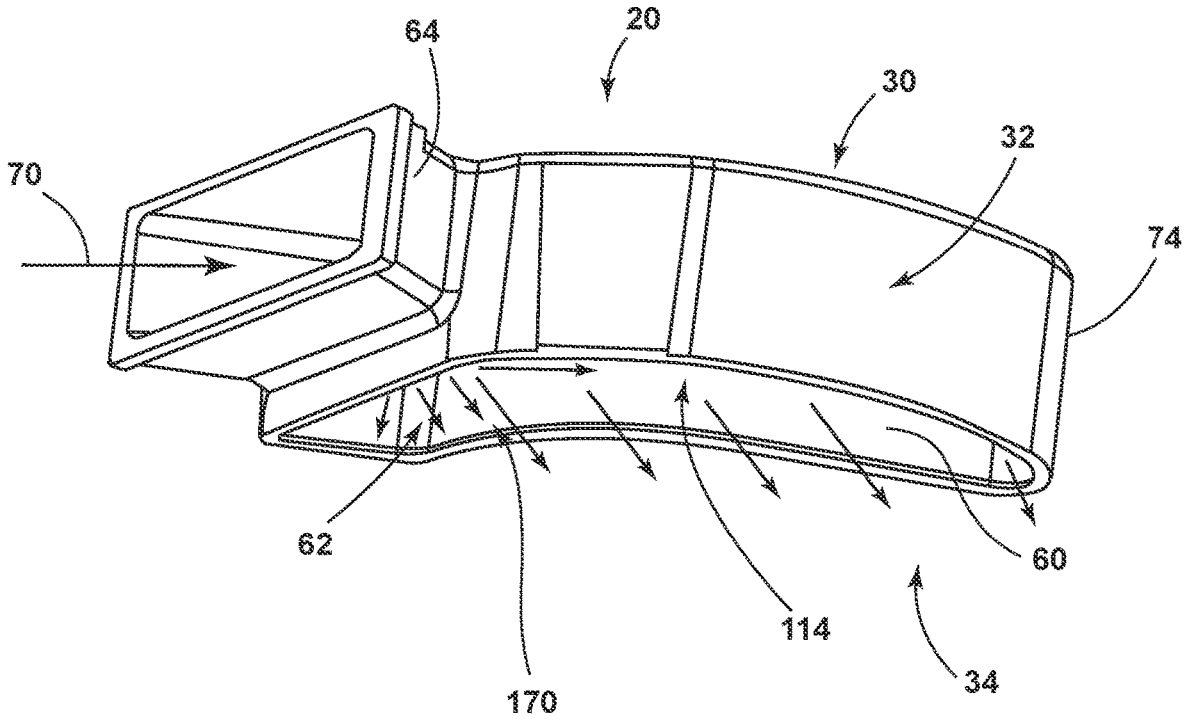
FIG. 12 is a bottom perspective view of the prewash nozzle of FIG. 9.
Figure 13:
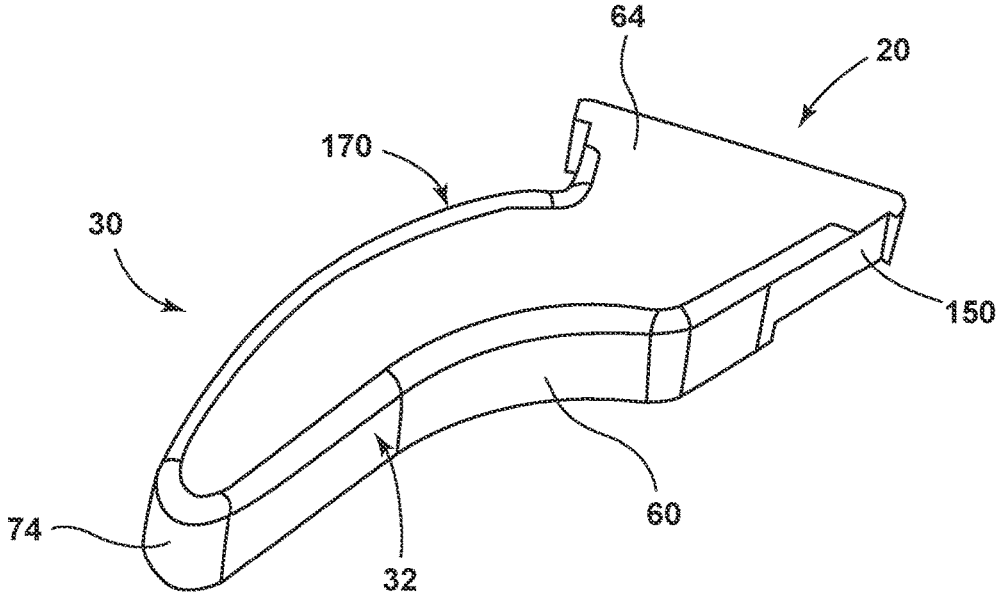
FIG. 13 is a top perspective view of the prewash nozzle of FIG. 12.
Figure 14:
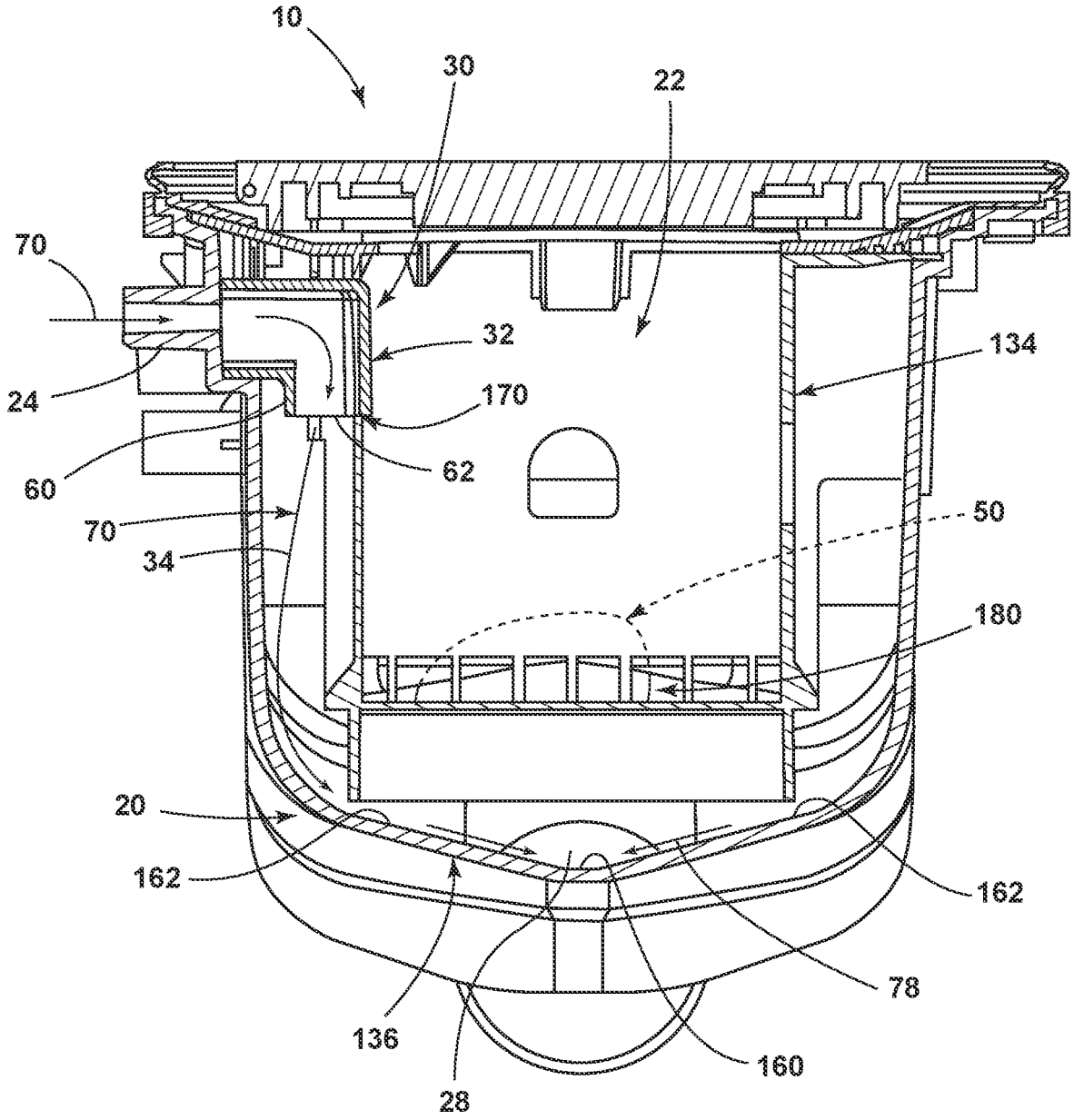
FIG. 14 is a cross-sectional view of the chemistry dispensing module of FIG. 2 taken along line XIV-XIV.
Figure 15:
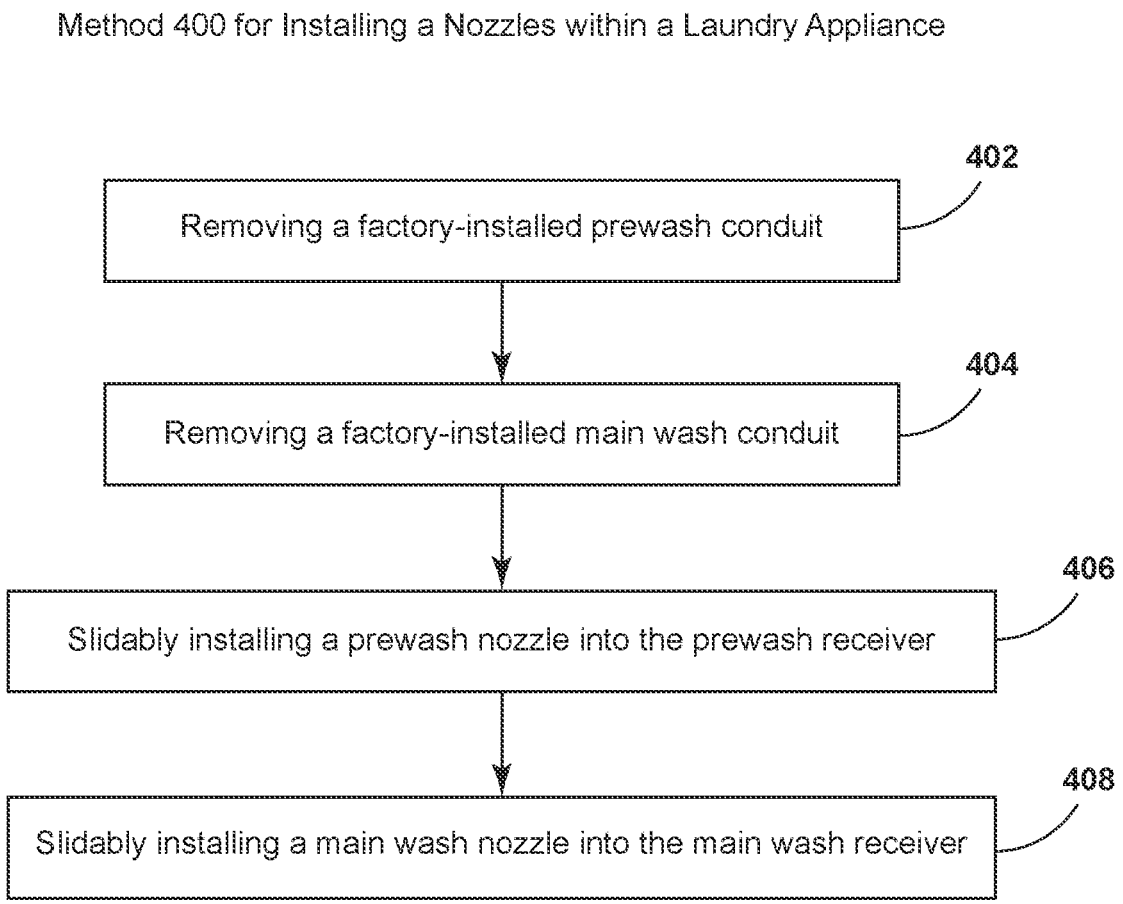
FIG. 15 is a linear flow diagram illustrating a method for installing the prewash nozzle within a laundry appliance.
Figure 16:
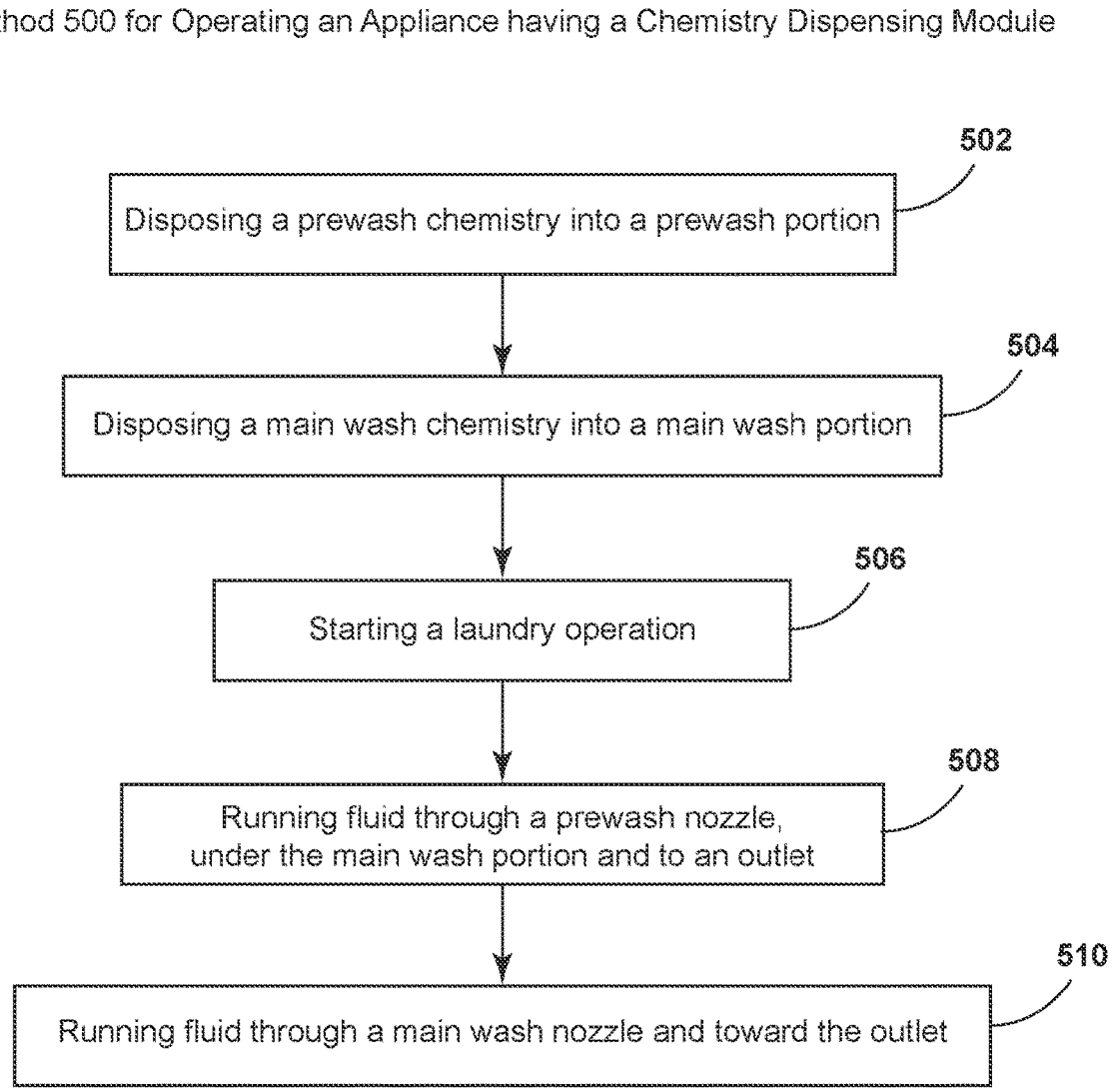
FIG. 16 is a linear flow diagram illustrating a method for operating a laundry appliance that utilizes an aspect of the chemistry dispensing module.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With respect to FIGS. 1-14, reference numeral 10 generally refers to a chemistry dispensing module for use within a laundry appliance 12. The laundry appliance 12 can include a drum 14 that is rotationally operable within a wash tub 16. A chemistry receptacle 18 is located proximate the drum 14 and is configured to receive chemistry for treating laundry, typically detergent, bleach, fabric softener, and other similar chemistry-related items used for treating laundry. The chemistry dispensing module 10 can be coupled to the chemistry receptacle 18. The chemistry dispensing module 10 includes a prewash portion 20 and a main wash portion 22. A first fluid inlet 24 is coupled with a prewash portion 20 and a second fluid inlet 26 is coupled with the main wash portion 22. A fluid outlet 28 extends from the chemistry dispensing module 10 to a laundry treating chamber, typically within the drum 14 for the wash tub 16 of the appliance 12. A prewash nozzle 30 is coupled to the first fluid inlet 24 and the prewash portion 20. The prewash nozzle 30 includes an elongated arcuate body 32 that follows a curvature of the prewash portion 20 and defines a cyclonic flow from the prewash nozzle 30 into the fluid outlet 28. The chemistry dispensing module 10 also includes a main wash nozzle 36 that is slidably coupled with the second fluid inlet 26. The main wash nozzle 36 includes an angled deflector 38. The angled deflector 38 is adapted to redirect a fluid 40, typically water 70, through the main wash portion 22 and to the outlet of the chemistry dispensing module 10.

Referring again to FIGS. 2-14, the chemistry dispensing module 10 is configured such that the main wash portion 22 is positioned at least partially above the prewash portion 20. In this manner, a fluid 40 moving through the prewash portion 20 is directed to at least partially flow under the main wash portion 22, or at least part of the main wash portion 22. Fluid 40 moving through the prewash portion 20 does not substantially enter into the main wash portion 22. Accordingly, the main wash chemistry 50 is maintained within a separate area and is not mixed with prewash chemistry 52.

Referring again to FIGS. 2-14, the prewash portion 20 is typically laterally offset from the main wash portion 22. Accordingly, the main wash portion 22 is at least partially located between the fluid outlet 28 of the chemistry dispensing module 10 and the prewash portion 20 of the chemistry dispensing module 10. Through this configuration, the user of the appliance 12 can dispense the prewash chemistry 52 into the prewash portion 20 of the chemistry dispensing module 10. At the same time, the user can also dispense the main wash chemistry 50 into the main wash portion 22 of the chemistry dispensing module 10. During operation of the appliance 12, a fluid 40, such as tap water 70, moving through the first fluid inlet 24 can pass through the prewash nozzle 30 and extend in a cyclonic or laminar flow through the prewash portion 20 and toward the fluid outlet 28. As the prewash fluid 78 that contains the water 70 and prewash chemistry 52 moves toward the fluid outlet 28, this prewash fluid 78 moves in a laminar flow and under at least a portion of the main wash portion 22. The main wash chemistry 50 is contained within the main wash portion 22 as the prewash fluid 78 moves underneath.

After the prewash portion 20 of a particular laundry cycle is complete, water 70 can move through the second fluid inlet 26 and through the main wash nozzle 36 for washing out main wash chemistry 50 from the main wash portion 22 of the chemistry dispensing module 10. Through the use of the prewash nozzle 30 and the main wash nozzle 36, the prewash and main wash chemistries 52, 50 can be completely dispensed into the laundry treating chamber or substantially dispensed into the laundry treating chamber, without being mixed together. Through the use of the prewash and main wash nozzles 30, 36, little, if any, of the prewash and/or main wash chemistry 52, 50 remains within the chemistry dispensing module 10 after the completion of the laundry cycle.

Referring again to FIGS. 2, 3 and 9-14, the prewash nozzle 30 includes the elongated arcuate body 32 that includes a substantially continuous arcuate wall 60. This continuous arcuate wall 60 is configured to extend from the first fluid inlet 24 and to an open bottom 62 of the prewash nozzle 30. Through this configuration, fluid 40 moving through the first fluid inlet 24 is configured to move into the prewash adapter 64 of the prewash nozzle 30 and into the elongated arcuate body 32. The configuration of the prewash nozzle 30 is adapted to form a substantially cyclonic and laminar flow path 34 from the prewash nozzle 30 and through the prewash portion 20 of the chemistry dispensing module 10. The shape of the prewash nozzle 30 is also configured to form and follow this cyclonic and laminar flow path 34 under a variety of fluid pressures, as will be described more fully below.

Within various residential and commercial settings, water pressure within a particular structure can vary depending upon the amount of water 70 being used at any particular time. Usage of water 70 within a number of locations within a structure can decrease the overall pressure of water 70 within any one water outlet, such as within a laundry appliance 12. The prewash nozzle 30 forms a substantially gradual arcuate shape that defines a laminar guide 170 and allows for at least minimal deflection or cyclonic flow for moving the water 70 in a generally downward direction 118 toward the rounded end 100 of the prewash portion 20 of the chemistry dispensing module 10. Certain portions of the elongated arcuate body 32 can interact with the water 70 to create a fan-shaped spray, particularly near the pre-wash adapter 64. Under a high pressure 72 of the water 70, the water 70 moving through the prewash nozzle 30 may reach or flow near to an arcuate end 74 of the prewash nozzle 30. Where a low pressure 76 flow of the water 70 is present for water 70 leaving the first fluid inlet 24, the water 70 may extend only minimally into the elongated arcuate body 32. The arcuate configuration of the prewash nozzle 30, as discussed above, is adapted to form the cyclonic and laminar flow path 34 of the water 70 and the prewash fluid 78 from the prewash portion 20 and toward the outlet, under both high pressure 72 and low pressure 76 of the water 70.

Referring again to FIGS. 9-13, the prewash adapter 64 of the prewash nozzle 30 is configured to slidably engage a prewash receiver 90 that is defined within the prewash portion 20 of the chemistry dispensing module 10. Through this configuration, the prewash adapter 64 can be slidably engaged within and slidably removed from the chemistry dispensing module 10. This configuration of the prewash receiver 90 and the prewash adapter 64 allows for a removal or replacement of a prewash nozzle 30.

Referring again to FIGS. 9-14, the prewash portion 20 of the chemistry dispensing module 10 includes a substantially rounded end 100 that cooperates with the elongated arcuate body 32 of the prewash nozzle 30. When the prewash nozzle 30 is inserted within the prewash receiver 90, the elongated arcuate body 32 of the prewash nozzle 30 is adapted to at least partially nest or seat within the rounded end 100 of the prewash portion 20. This congruent configuration between the prewash nozzle 30 and the prewash portion 20 of the chemistry dispensing module 10 encourages the cyclonic flow path 34 through the chemistry dispensing module 10 as a laminar flow path 34 at least from the open bottom 62 of the prewash nozzle 30 into the fluid outlet 28. As discussed above, the laminar flow path 34 of the prewash fluid 78 from the prewash nozzle 30 into the fluid outlet 28 extends cyclonically around the rounded end 100 of the chemistry dispensing module 10. The cyclonic flow path 34 then extends beneath the main wash portion 22 and toward the fluid outlet 28 of the chemistry dispensing module 10.

Referring now to FIGS. 3-8, the main wash nozzle 36 can include a deflecting body in the form of the angled deflector 38 that is adapted to redirect a flow of the water 70 from the second fluid outlet 28 and toward the main wash portion 22 of the chemistry dispensing module 10. The main wash nozzle 36 includes a main wash adapter 110 that is adapted to slidably engage the main wash receiver 112 defined within the chemistry dispensing module 10. The main wash adapter 110 of the main wash nozzle 36 extends into an enlarged space 114 through which the flow of the water 70 moving through the main wash nozzle 36 can be redirected in a substantially fan-shaped configuration. The enlarged space 114 is surrounded by an outer wall 116 that includes the angled deflector 38. As with the prewash nozzle 30, the main wash nozzle 36 is configured to redirect the flow of water 70 into the main wash nozzle 36 under a variety of water pressures. Where a low pressure 76 of water 70 is provided, the water 70 will minimally drop within the enlarged space 114 of the main wash nozzle 36 and engage the deflecting panel at a slightly lower position. This redirection will be in a generally downward direction 118 and into the main wash portion 22. The redirection of the water 70 by the angled deflector 38 typically results in the water 70 following the angle of the angled deflector 38. The water 70, following this angle and moving in the generally downward direction 118, results in a complete or substantially complete washout of the main wash chemistry 50 within the main wash portion 22. Where the water 70 entering the main wash nozzle 36 has a high pressure 72, the water 70 will hit the deflecting panel at a higher position and may result in a different fan-shaped spray of water 70 into the main wash portion 22, but still in the generally downward direction 118.

According to various aspects of the device, the prewash nozzle 30 and the main wash nozzle 36 are each configured so that changes in the pressure of the water 70 moving through the first and second fluid inlets 24, 26 can be provided for. In this manner, water 70 moving through the prewash and main wash nozzles 30, 36, regardless of high pressure 72 or low pressure 76, can result in a complete, or substantially complete, rinsing of prewash chemistry 52 and main wash chemistry 50 from the chemistry dispensing module 10. By rinsing out all or substantially all of the various chemistries disposed within the chemistry dispensing module 10, build-up or other unwanted accumulation of these chemistries can be avoided over extended use of the appliance 12.

Referring again to FIGS. 2-14, the chemistry dispensing module 10 as seated within the chemistry receptacle 18 of the appliance 12 can include a dispenser housing 130 that defines each of the prewash and main wash portions 20, 22. As discussed above, the main wash portion 22 is typically located between the prewash portion 20 and the fluid outlet 28 defined within the dispenser housing 130. The dispenser housing 130 can include each of the prewash and main wash receivers 90, 112 that are configured to slidably receive each of the prewash and main wash nozzles 30, 36, respectively. A dispenser frame 132 can be positioned on top of the dispenser housing 130. It is contemplated that the dispenser frame 132 can receive a chemistry cup 134 that is adapted to receive the main wash chemistry 50 within the main wash portion 22. The chemistry cup 134 can be attached to the dispenser frame 132, or can be attached to the dispenser housing 130. The chemistry cup 134 is typically elevated above the rounded floor 136 of the dispenser assembly. The chemistry dispensing module 10 can also include an upper trim 138 and various user interface indicia 140 relating to the various dispensing features of the chemistry dispensing module 10.

Referring again to FIGS. 3-14, the prewash adapter 64 and main wash adapter 110 of the prewash and main wash nozzles 30, 36, respectively, can each include a flared end 150 that is configured to matingly engage the prewash receiver 90 and main wash receiver 112, respectively. Using this flared end 150, a slidable engagement can be achieved, as well as a sealing engagement that minimizes or eliminates leakage between the prewash nozzle 30 and the prewash receiver 90, as well as between the main wash nozzle 36 and the main wash receiver 112.

Referring again to FIGS. 1-14, it is contemplated that the prewash nozzle 30 and main wash nozzle 36 can each be an after-market nozzles that are intended to replace a factory-installed set of nozzles. The factory installed set of nozzles can be slidably removed from each of the prewash and main wash receivers 90, 112. The prewash and main wash nozzles 30, 36 can then be inserted into the respective receiver. This operation can be configured to be performed by a user of the appliance 12. Typically, the replacement of the factory-installed nozzles with the prewash and main wash nozzles 30, 36 will be performed by a service technician as part of a service call for maintaining the appliance 12. According to various aspects of the device, the prewash and main wash nozzle 30, 36 can also be installed at a factory setting. These factory installed members can be optional pieces that may be included as part of a particular trim, platform or model of a laundry appliance 12.

Referring again to FIGS. 2-14, the dispenser housing 130 can include a rounded end 100 that forms at least a portion of the prewash portion 20 of the chemistry dispensing module 10. In various aspects of the device, the lower region of the dispenser housing 130 can include a generally arcuate or rounded floor 136 having a transverse guide 160 that promotes the cyclonic flow path 34 and the laminar movement of the prewash fluid 78 toward the fluid outlet 28. As discussed above, the cyclonic flow path 34 typically extends from the open bottom 62 of the prewash nozzle 30, along the lower surface or rounded floor 136 of the dispenser housing 130, and through the fluid outlet 28 of the dispenser housing 130 for the chemistry dispensing module 10. By promoting the cyclonic flow path 34 and the laminar flow of the prewash fluid 78, all, or substantially all, of the prewash chemistry 52 can be efficiently and effectively rinsed from the chemistry dispensing module 10 and through the fluid outlet 28 for use within the laundry treating chamber for the appliance 12.

Referring again to FIGS. 2-14, the transverse guide 160 can be formed between opposing angled surfaces 162 that further define the rounded floor 136 of the dispenser housing 130. The transverse guide 160 is configured to lead to the fluid outlet 28 and further promotes the laminar flow through the cyclonic flow path 34. The cyclonic flow path 34 along the rounded floor 136 can result in prewash fluid 78 flowing in a cyclonic motion or a sinusoidal motion over the opposing angled surfaces 162 of the dispenser housing 130. Using the prewash nozzle 30, the flow of water 70 and the prewash fluid 78 is in this sinusoidal and cyclonic motion is achieved. This motion of the prewash fluid 78 through the flow path 34 is configured to guide the prewash fluid 78 through and over a majority of the rounded floor 136 to capture and retain most, if not all, of the prewash chemistry 52 within the prewash fluid 78 that flows through the fluid outlet 28.

Referring again to FIGS. 1-14, the chemistry dispensing module 10 for the laundry appliance 12 can include the dispenser housing 130 that includes the prewash portion 20 and the main wash portion 22. The first fluid inlet 24 is coupled with the prewash portion 20 and a second fluid inlet 26 is coupled with the main wash portion 22. As discussed above, the prewash portion 20 includes the rounded end 100. This rounded end 100 typically transitions smoothly into the rounded bottom surface of the dispenser housing 130 and generally along the transverse guide 160 to promote the cyclonic flow path 34 in the laminar flow of the prewash fluid 78. The fluid outlet 28 extends from the chemistry dispensing module 10 to the laundry treating chamber. The prewash nozzle 30 is configured to be coupled to the first fluid inlet 24 as well as the prewash portion 20. The prewash nozzle 30 includes the elongated arcuate body 32 that seats within the rounded end 100 and also defines the laminar cyclonic flow path 34 from the prewash nozzle 30 to the fluid outlet 28 that moves the prewash fluid 78 over at least a majority of the rounded floor 136. The prewash portion 20 is positioned at least partially below the main wash portion 22. In this manner, the prewash portion 20 allows for the flow for the prewash fluid 78 on the rounded floor 136 and beneath the chemistry receptacle 18 for the main wash portion 22 of the chemistry dispensing module 10. As discussed above, the elongated arcuate body 32 of the prewash nozzle 30 includes a substantially continuous arcuate wall 60 that extends from the first fluid inlet 24 to define a laminar guide 170 within the arcuate wall 60. The laminar guide 170 at least partially defines the laminar cyclonic flow path 34.

According to various aspects of the device, each of the prewash and main wash nozzles 30, 36 are unitary and integral pieces that may be molded from various plastic-type materials.

Referring again to FIGS. 2-14, the chemistry dispensing module 10 for the laundry appliance 12 includes the dispenser housing 130 that includes the fluid outlet 28. The first fluid inlet 24 is disposed within the prewash portion 20 of the dispenser housing 130. As noted previously, the prewash portion 20 includes a rounded end 100. The second fluid inlet 26 is disposed within the main wash portion 22 of the dispenser housing 130. The main wash portion 22 is at least partially positioned over the prewash portion 20. The prewash nozzle 30 slidably couples with the first fluid inlet 24.

Again, the prewash nozzle 30 includes the elongated arcuate body 32 that seats within the rounded end 100 and defines the laminar cyclonic flow path 34 from the prewash nozzle 30 to the fluid outlet 28. The main wash nozzle 36 includes the angled deflector 38 that is adapted to direct fluid 40, typically water 70, through the main wash portion 22 to the fluid outlet 28. Each of the prewash and main wash nozzles 30, 36 are configured to taper from the prewash adapter 64 and main wash adapter 110, respectively. This tapered configuration helps to redirect the flow of water 70 from the first fluid inlet 24 and second fluid inlet 26, respectively, and through the enlarged space 114 of each of the prewash and main wash nozzles 30, 36. With respect to the prewash nozzle 30, the enlarged space 114 is defined by the continuous arcuate wall 60 that extends around the perimeter of the prewash nozzle 30 to define the laminar guide 170 and the open bottom 62 for directing the water 70 through the prewash nozzle 30 to form the laminar cyclonic flow path 34 along the rounded floor 136. The main wash nozzle 36 includes the angled deflector 38 that extends from the enlarged space 114 for the main wash nozzle 36. As discussed above, these components of the prewash and main wash nozzles 30, 36 are configured to provide a predetermined flow of water 70 from the first and second fluid inlets 24, 26 and through the respective prewash and main wash nozzles 30, 36 under a variety of water pressures experienced within the laundry appliance 12.

Referring now to FIGS. 1-15, having described various aspects of the chemistry dispensing module 10, a method 400 is disclosed for installing a prewash nozzle 30 within a laundry appliance 12. According to the method 400, a manufacturer installed prewash conduit or nozzle (not shown) is removed (step 402). The manufacturer installed main wash conduit or nozzle (not shown) is also removed (step 404). The prewash nozzle 30 having a laminar guide 170 is then slidably installed into the prewash receiver 90 (step 406). The main wash nozzle 36, having an angled deflector 38, is also slidably installed within a main wash receiver 112 (step 408). As discussed above, this operation can be performed as an after-market operation as part of a service call or improvement to the appliance 12 after purchase.

Referring now to FIGS. 1-14 and 16, a method 500 is disclosed for operating an appliance 12 having an aspect of the chemistry dispensing module 10. According to the method 500, a prewash chemistry 52 is disposed within a prewash portion 20 of the chemistry dispensing module 10 (step 502). A main wash chemistry 50 is also disposed within a main wash portion 22 of the chemistry dispensing module 10 (step 504). A wash operation is then started either automatically or through a user selection (step 506). Fluid 40 is then run through the prewash nozzle 30 and toward the outlet (step 508). As discussed above, the prewash nozzle 30 and the dispenser housing 130 define the laminar cyclonic flow path 34 that flows along the rounded floor 136 and under the main wash portion 22 of the chemistry dispensing module 10. Using this configuration, the prewash portion 20 of a wash cycle can be performed without substantially disturbing the main wash chemistry 50 that is contained, at an elevated level, above the prewash portion 20 of the chemistry dispensing module 10. According to the method 500, fluid 40 is then run through the main wash nozzle 36 and to the fluid outlet 28 (step 510). As discussed above, the fluid 40 is deflected by the angled deflector 38 and into the chemistry cup 134 of the main wash portion 22. As fluid 40 moves through the main wash portion 22, the fluid 40 spills through main wash apertures 180 defined within the chemistry cup 134 of the main wash portion 22. This fluid 40 containing the main wash chemistry 50 then runs along a similar flow path 34 as that of the prewash fluid 78 between the main wash portion 22 and the outlet.

According to various aspects of the device, the chemistry used within the chemistry dispensing module 10 can be various chemistries similar to those discussed herein. Additionally, the form of the chemistry can also vary. The forms of chemistry can also include, but are not limited to, liquids, powders, granules, chemistry packets, chemistry containers having solid members, combinations thereof and other similar components. It is also contemplated that various forms of chemistry can be placed over each of the prewash and main wash portions 20, 22.

It is contemplated that the chemistry dispensing module 10 disclosed herein can be used within various appliances 12 that can include, but are not limited to, washers, combination washers and dryers, drying appliances, dishwashing appliances, and other similar appliances where various chemistries are dispensed within a particular treatment chamber.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above are merely for illustrative purposes and not intended to limit the scope of the device, which is defined by the following claims as interpreted according to the principles of patent law, including the Doctrine of Equivalents.

What is claimed is:

1. A chemistry dispensing module for an appliance, the chemistry dispensing module comprising:

a dispenser housing having a plurality of fluid portions, the plurality of fluid portions including a prewash portion;

a first fluid inlet coupled with the prewash portion and a second fluid inlet coupled to a separate wash fluid portion of the plurality of fluid portions, the prewash portion having a rounded end;

an outlet that extends from the dispenser housing and configured to direct a fluid to a laundry treating chamber; and a prewash nozzle slidably coupled to the first fluid inlet and the prewash portion, wherein the prewash nozzle includes an elongated arcuate body that seats within the rounded end and defines a laminar flow path from the prewash nozzle to the outlet.

2. The chemistry dispensing module of claim 1, wherein the prewash portion is positioned at least partially below the separate wash fluid portion of the plurality of fluid portions.

3. The chemistry dispensing module of claim 2, wherein the separate wash fluid portion includes a main wash portion that is coupled to the second fluid inlet.

4. The chemistry dispensing module of claim 1, wherein a fluid moving through the prewash portion passes under at least a portion of the separate wash fluid portion.

5. The chemistry dispensing module of claim 1, wherein the elongated arcuate body includes a continuous arcuate wall that extends from the first fluid inlet to define a laminar guide within the continuous arcuate wall, wherein the laminar guide partially defines the laminar flow path.

6. The chemistry dispensing module of claim 1, wherein the prewash nozzle is slidably engaged with the first fluid inlet.

7. The chemistry dispensing module of claim 6, wherein the prewash nozzle is an after-market nozzle that is configured to replace a manufacturer-installed nozzle.

8. The chemistry dispensing module of claim 3, further comprising:

a main wash nozzle slidably coupled with the second fluid inlet, wherein the main wash nozzle includes an angled deflector, the angled deflector adapted to redirect a main wash fluid through the main wash portion and to the outlet.

9. The chemistry dispensing module of claim 3, wherein the prewash portion is laterally offset from the main wash portion within the dispenser housing.

10. A chemistry dispensing module comprising:

a housing having a prewash portion, a separate wash portion and a fluid outlet;

a first fluid inlet coupled with the prewash portion and a second fluid inlet coupled to the separate wash portion; and a prewash nozzle coupled to the first fluid inlet and the prewash portion, wherein the prewash nozzle includes an elongated arcuate body that follows a curvature of the prewash portion and defines a cyclonic flow path from the prewash nozzle to the fluid outlet.

11. The chemistry dispensing module of claim 10, wherein the separate wash portion is positioned at least partially above the prewash portion.

12. The chemistry dispensing module of claim 10, wherein the separate wash portion is a main wash portion that includes the second fluid inlet.

13. The chemistry dispensing module of claim 12, wherein a fluid moving through the prewash portion does not substantially enter into the main wash portion.

14. The chemistry dispensing module of claim 10, wherein the elongated arcuate body includes a continuous arcuate wall that extends from the first fluid inlet to an open bottom of the prewash nozzle.

15. The chemistry dispensing module of claim 14, wherein the prewash nozzle and the prewash portion cooperate to define the cyclonic flow path as a laminar flow path at least from the open bottom of the prewash nozzle and to the fluid outlet.

16. The chemistry dispensing module of claim 10, wherein the prewash nozzle is slidably engaged with the first fluid inlet.

17. The chemistry dispensing module of claim 15, wherein the prewash nozzle is an after-market nozzle that is configured to replace a manufacturer installed nozzle.

18. The chemistry dispensing module of claim 12, further comprising:

a main wash nozzle slidably coupled with the second fluid inlet, wherein the main wash nozzle includes an angled deflector, the angled deflector adapted to redirect a main wash fluid through the main wash portion and to the fluid outlet.

19. An appliance comprising:

a chemistry receptacle located proximate an article treating chamber;

a chemistry dispensing module coupled to the chemistry receptacle and having a plurality of wash portions that includes a prewash portion;

a first fluid inlet coupled with the prewash portion and a second fluid inlet coupled to a separate portion of the plurality of wash portions;

an outlet that extends from the chemistry dispensing module to the article treating chamber; and a prewash nozzle coupled to the first fluid inlet and the prewash portion, wherein the prewash nozzle includes an elongated arcuate body that follows a curvature of the prewash portion and defines a cyclonic flow path from the prewash nozzle to the outlet.

20. The appliance of claim 19, wherein the elongated arcuate body includes a substantially continuous arcuate wall that extends from the first fluid inlet to an open bottom of the prewash nozzle, wherein the prewash nozzle and the prewash portion cooperate to define the cyclonic flow path as a laminar flow path at least from the open bottom of the prewash nozzle and to the outlet.

* * * * *